United States Patent [19]

Duym

[11] 4,160,407

[45] Jul. 10, 1979

[54] VENTILATING SYSTEM

[75] Inventor: Arthur Duym, Fanwood, N.J.

[73] Assignee: Bell Telephone Laboratories, Incorporated, Murray Hill, N.J.

[21] Appl. No.: 852,663

[22] Filed: Nov. 18, 1977

[51] Int. Cl.[2] ..... F23J 11/00

[52] U.S. Cl. ..... 98/115 R; 55/DIG. 18; 126/299 R; 165/16; 98/33 R

[58] Field of Search ..... 98/115 R, 115 LH, 33 R; 104/52; 266/158, 159; 55/DIG. 18; 126/299 R, 299 D; 165/16

[56] References Cited

U.S. PATENT DOCUMENTS

| | | | |
|---|---|---|---|
| 1,552,316 | 9/1925 | Krieg | 98/115 R |
| 1,630,317 | 5/1927 | Skonier | 98/115 R |
| 1,676,969 | 7/1928 | Sutton et al. | 98/115 R |
| 3,766,906 | 10/1973 | Jenn | 126/299 R |
| 3,800,689 | 4/1974 | Brown | 126/299 D |
| 3,982,583 | 9/1976 | Shavit | 165/16 |
| 4,050,368 | 9/1977 | Eakes | 98/115 LH |
| 4,058,299 | 11/1977 | Lindkvist | 98/115 LH |

*Primary Examiner*—Ronald C. Capossela
*Attorney, Agent, or Firm*—Peter V. D. Wilde

[57] ABSTRACT

The wasteful discharge of heated or cooled room air in a ventilating system to which a number of fume hoods are connected is reduced by making it possible to turn off unused hoods without unduly unbalancing the system and by making it possible, when access windows are closed, to reduce the volume of air flow to below the required open window level. Unconditioned outside air is automatically fed into the system in an amount compensating for the reduction in air available from the hoods when they are shut off or when flow from them is reduced. Switches are provided on the hood windows to change hood damper openings automatically to increase air flow when access windows are open and reduce it when windows are closed.

2 Claims, 3 Drawing Figures

VENTILATING SYSTEM

BACKGROUND OF THE INVENTION

In laboratory or manufacturing buildings using a large number of fume hoods connected to a central exhaust system of essentially constant flow volume, the system should be balanced by adjusting the volume of air exhausted through each hood to within the permissible air velocity limits. In order to keep the system in balance, it is necessary that the volume of air supplied from each hood be maintained reasonably constant, whether the hood is in use or not and, in the case of enclosed hoods with access windows, whether the window of the hood is open or closed.

As a result, during periods when the hood is not in use, tempered and often purified room air is still being exhausted in large volume since the connection of the hood to the exhaust system cannot be closed off without upsetting the balance of the system. Similarly, when the hood is in use, the volume of air drawn through it must be maintained at the high value required to sustain the requisite air velocity through an open access window and cannot be significantly reduced when the window is closed. This results in a substantial waster of the energy required to heat or cool the room air which is then uselessely discharged through the exhaust outlet in great volume.

SUMMARY OF THE INVENTION

According to the present invention, the air intake of individual hoods can be varied or completely shut off without unduly disturbing the system balance. This is accomplished by admitting air from outside the building or ventilated area into the exhaust system in an amount compensating for any decrease in the overall volume of flow from the hoods below that at which balance of the system was established.

A convenient arrangement for achieving this result provides an outside air intake opening into the draft duct system to which the hoods are connected and also provides an automatic damper at the air intake which opens and closes in response to a pressure sensor located inside the draft system so as to return the draft vacuum to the preset level. With this arrangement, any hood connected to the system can be shut off without unduly affecting the air flow through the other hoods on the system.

Moreover, since the air flow from any hood can be varied without unduly disturbing the balance of the system, it is possible with enclosed hoods to provide for a lesser volume of air flow from the hood when the access window is closed than when it is open and thus to avoid the energy waste involved in drawing the maximum volume at all times. In conventional systems, enclosed hoods are commonly provided with a bypass intake for room air, which is closed off when the access window is open so that the full draft of room air is through the window but which is opened as the window is shut so as to maintain the full volume of flow into the draft system.

This wasteful bypass arrangement is eliminated according to the present invention by providing an automatic damper in the duct connecting the hood to the draft system, the opening of the damper being controlled by a pressure sensor between the damper and the hood so as to maintain a preset pressure level. A switch is mounted so that it is actuated by the opening of the access window closure a certain degree, for instance to a position one-half or one-third open, and upon actuation it automatically changes the preset pressure level to one creating the required greater volume flow of air through the window. Upon closing of the closure to the same point, actuation of the switch automatically changes the preset pressure level so as to reduce the volume flow of air to the closed window level. If desired, more than one switch can be provided at different degrees of closure opening so as to produce a graded change in preset pressure level and thus a graded change in air volume flow, or a continuous control can be associated with the closure to cause a continuous change in flow with change in the degree of opening.

DETAILED DESCRIPTION

Figure 1:
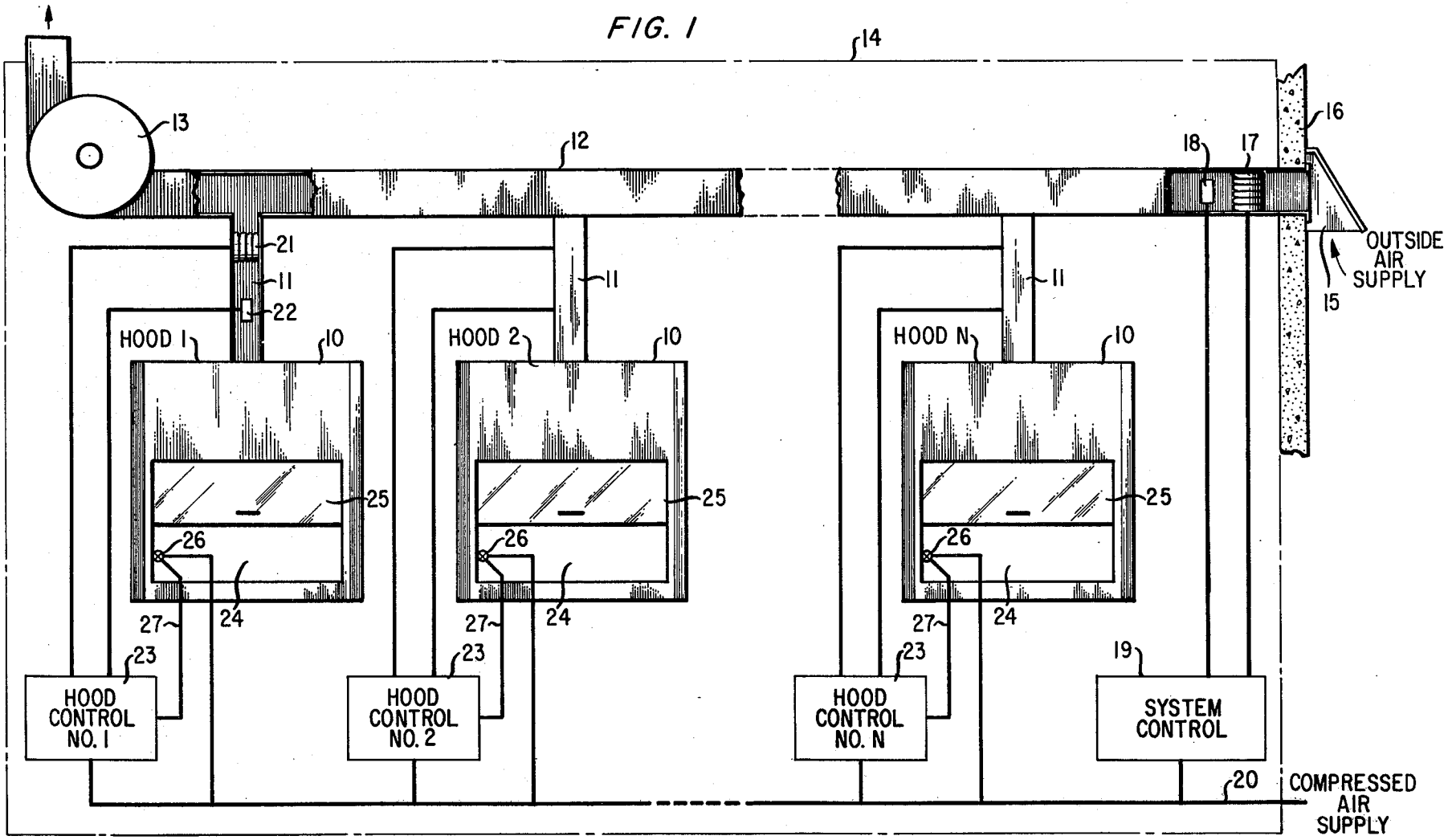
FIG. 1 is a diagrammatic representation, partly in section, of an embodiment of the ventilating system of the present invention in which control is effected by means of compressed air.

A convenient embodiment of the ventilating system of the present invention in which the controls are powered by compressed air is shown in the drawing.

In FIG. 1 a plurality of enclosed fume hoods 10 are shown connected by hood exhaust ducts 11 to duct 12 of the draft system through which a constant volume of air flow is maintained by blower 13 which discharges outside the building enclosure represented diagrammatically by dotted line 14 in which the hoods are located.

Outside air is controllably admitted to the draft system through air inlet 15 outside the building wall 16. A bellows damper 17 is positioned in the draft system between the outside air supply and the hood exhaust connections to the draft system. A pressure sensor 18 is located between the bellows damper 17 and the hood exhaust connections to the draft system.

Figure 2:
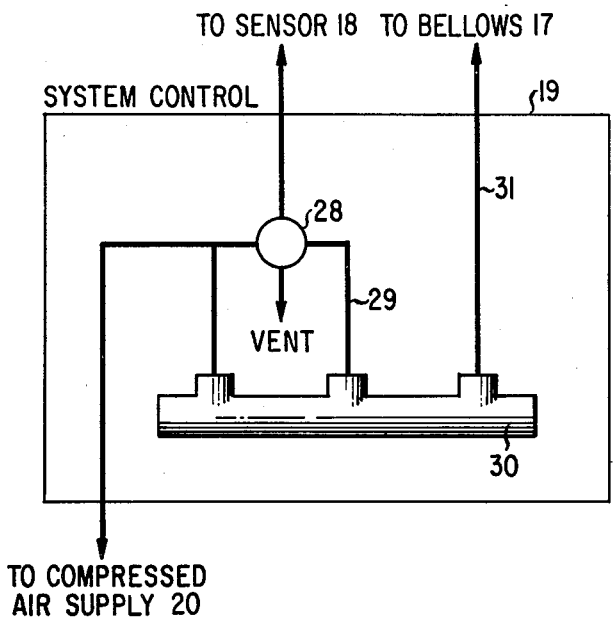
FIG. 2 is a diagrammatic representation of the compressed air control within the block labeled "System Control" in FIG. 1.

A system control arrangement shown in more detail in FIG. 2 is provided which is powered by compressed air supply 20 and which opens and closes bellows damper 17 in response to pressure sensor 18 so as to maintain an essentially constant pressure in the draft system. Thus, when one or more hoods are cut off in the system by having their hood exhaust connections closed off, the resulting change in pressure in the constant flow draft system is compensated by the opening of bellows damper 17 in response to pressure sensor 18 so as to admit sufficient outside air to compensate for the reduced discharge of room air into the system. A similar compensation is made when the hoods are not completely disconnected from the system but admit varying amounts of room air to the system as the access windows are opened or closed as will be described in more detail below.

In each hood exhaust duct is located a bellows damper 21 associated with a pressure sensor 22 located in the duct between the damper and the hood. Each hood is provided with a compressed air powered hood control 23, described in more detail in FIG. 3, which actuates the corresponding damper 21 in response to corresponding pressure sensor 22 so as to maintain an essentially constant preset exhaust pressure on the hood.

Each hood has an access window 24 provided with a vertically sliding sash 25 which can be lowered to a position fully closing the window or raised to a position providing full access to the hood.

In each window is mounted a valve 26 controlling a flow of compressed air in line 27 to the hood control. This valve is mounted in a position in which it is actuated by sash 25 so as to be closed when the window is opened by raising the sash or to be opened when the window is closed by lowering the sash. The hood controls are so designed that when a valve 26 is closed by the opening of a window 25 the corresponding damper 21 is opened permitting maximum exhaust. When valve 26 is opened by the lowering of sash 25 to a closed position, damper 21 closes the requisite amount to reduce the exhaust through the hood to the lower level required for the closed window state. The pressure sensor 22 operates in conjunction with the hood control to maintain the proper damper opening for the two states. As discussed above, damper 17 and sensor 18 operate to maintain overall balance. Wasteful discharge of conditioned room air when the windows are closed is thus avoided.

A convenient arrangement of compressed air system control 19 is shown in FIG. 2. Sensor 18 is connected to static pressure regulator 28 and thus controls the pressured air delivered through line 29 to reversing relay 30 which in turn controls the pressure of compressed air delivered from line 31 to bellows 17.

Figure 3:
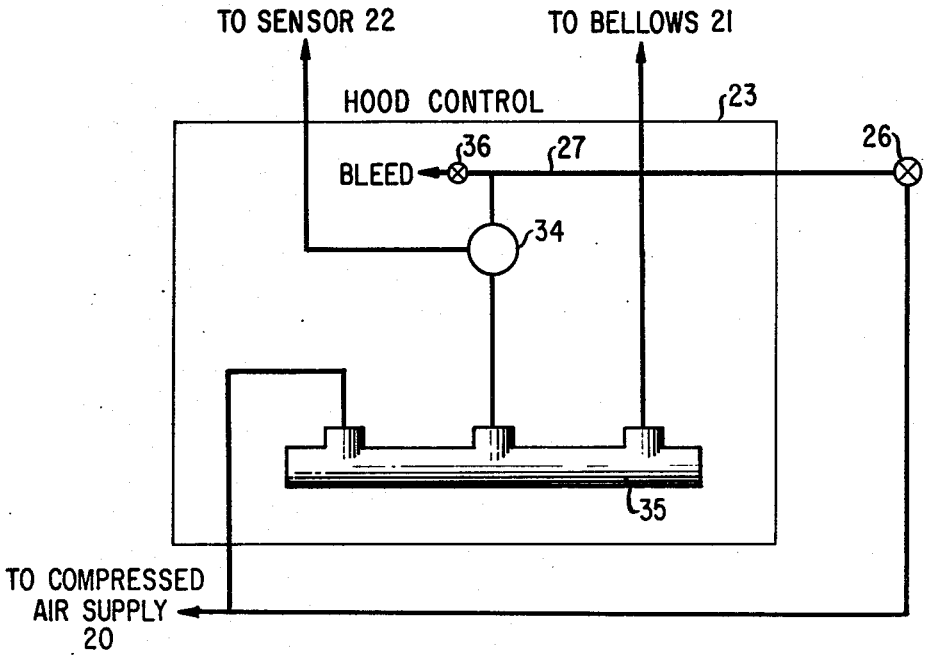
FIG. 3 is a diagrammatic representation of the compressed air control contained in the block labeled "Hood Control" in FIG. 1.

A convenient arrangement of compressed air powered hood control 23 is shown in FIG. 3. Sensor 22 and air line 27 controlled by valve 26 are both connected to pressure regulator 34 and thus control the pressure of air delivered to booster relay 35 which in turn controls the pressure delivered by the compressed air supply 20 to belows 21. The maximum exhaust in the opened window position is controlled by adjustment of the static pressure regulator 34. The minimum flow adjustment for the closed window position is made by adjusting bleed valve 36.

What is claimed is:

1. A ventilating system for an enclosure, said enclosure containing a plurality of ventilating hoods, each connected by a hood exhaust duct to a common draft system exhausting outside the enclosure, wherein the improvement comprises an atmospheric air supply having its source outside the enclosure and discharging into said draft system, an intake damper controlling the amount of air entering said draft system from said air supply and means responsive to the pressure within said draft system for maintaining a substantially constant pressure in said system by opening or closing said intake damper whenever the flow of air from the hoods to the draft system is reduced or increased, so as to increase or decrease the supply of outside air to the system in corresponding amounts and thus maintain the draft system in balance even though periodically hoods connected to the system are partially or completely shut off from the system, and further wherein at least one of said hoods is in enclosed hood having an access window equipped with a closure and wherein the hood exhaust valve associated with said hood is responsive to a pressure sensor in the corresponding hood exhaust duct between said valve and said hood to maintain a set pressure in said duct.

2. A ventilating system as defined in claim 1 wherein said window is provided with a switch so mounted as to be operated when said closure is opened to a certain fraction of its fully open position and means is provided which is activated by the operation of said switch to alter the set pressure maintained in the hood exhaust duct by altering the response to said hood exhaust valve to said pressure sensor, so that a greater volume of air is caused to flow through said window when said closure is in its open position than when it is in its closed position.

* * * * *